US005251345A

United States Patent [19]

Pechner

[11] Patent Number: 5,251,345

[45] Date of Patent: Oct. 12, 1993

[54] PORTABLE SHOWER AND WASH

[75] Inventor: Murray Pechner, 3309 W. Harvard St., Santa Ana, Calif. 92704

[73] Assignee: Murray Pechner, Santa Ana, Calif.

[21] Appl. No.: 836,223

[22] Filed: Feb. 12, 1992

[51] Int. Cl.[5] ..... A47K 3/22

[52] U.S. Cl. ..... 4/603

[58] Field of Search ..... 4/602, 603, 599, 600

[56] References Cited

U.S. PATENT DOCUMENTS

| | | | |
|---|---|---|---|
| 542,688 | 7/1895 | Shackleford . | |
| 1,957,365 | 5/1934 | Stewart . | |
| 2,454,518 | 11/1948 | McCann . | |
| 3,080,568 | 3/1963 | Burnett . | |
| 3,606,618 | 9/1971 | Veech | 4/603 |
| 3,629,875 | 12/1971 | Dow | 4/599 |
| 3,657,746 | 4/1972 | Downey | 4/603 X |
| 4,104,744 | 8/1978 | Odencrantz . | |
| 4,224,700 | 9/1980 | Bloys | 4/603 |
| 4,332,040 | 6/1982 | Palmer . | |
| 4,413,363 | 11/1983 | Troiano | 4/603 X |
| 4,453,280 | 6/1984 | Greenloaf | 4/603 X |
| 4,539,720 | 9/1985 | Westerweller . | |
| 5,111,538 | 5/1992 | Chapman | 4/603 X |

*Primary Examiner*—Charles E. Phillips

[57] ABSTRACT

A portable shower/emergency eye wash device (20) comprises a base portion (48), a handle-carrying portion (32) opposed to the base portion having a handle (30), and a walled structure (40, 42, 44, 46) joining the base portion and the handle-carrying portion into a drainable water tight enclosure (24). A recess (64) and a compartment (56) are closable by covers (57, 76). A rechargeable, sealed battery (54) and an electrically operated pump (52) are held within compartment (56). A hose 66 couples the pump to the enclosure interior and to the water therein. A spray head (28) and its hose (26) are secured to pump (52) through a hose 68 extending through an opening 62 to annular recess 64. The spray head may include a pump controlling electric switch and a water controlling valve for controlling the amount or discharge pattern of water being dispensed or sprayed. The hose is adapted to be coiled and retained along with the spray head within recess 64 when not in use and to be uncoiled and extended therefrom when used.

1 Claim, 5 Drawing Sheets

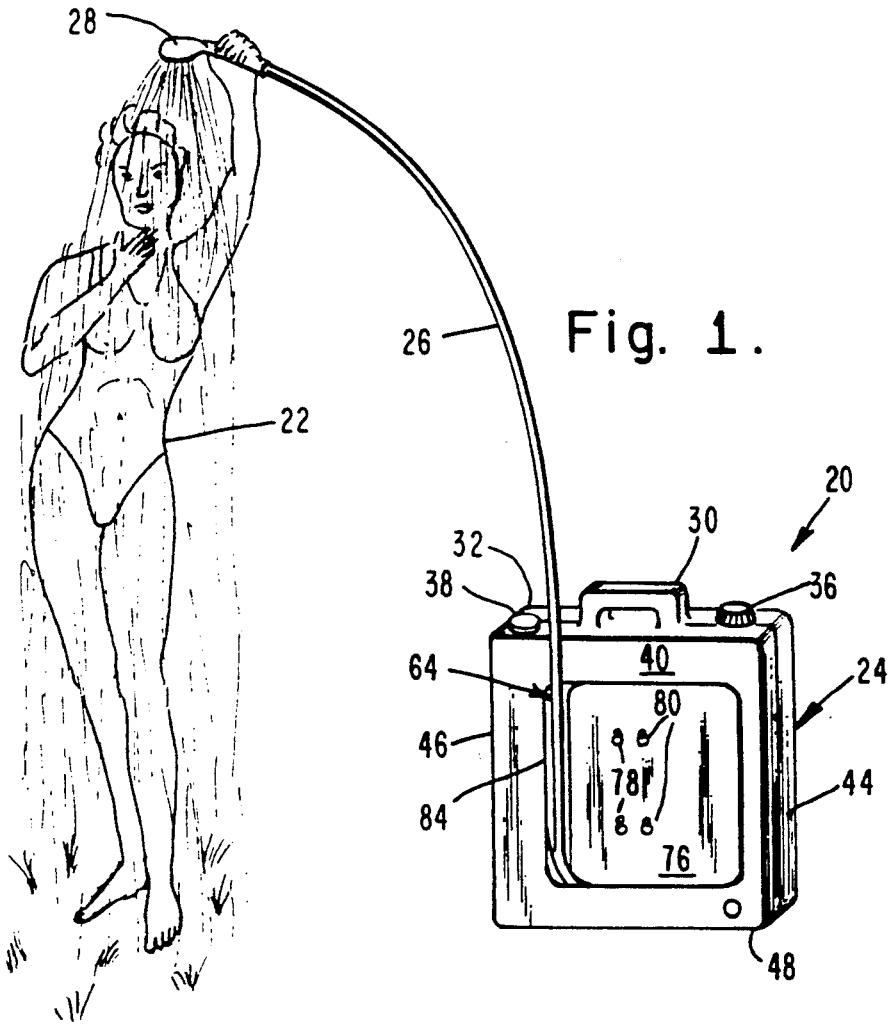
Fig. 1.
Fig. 2.
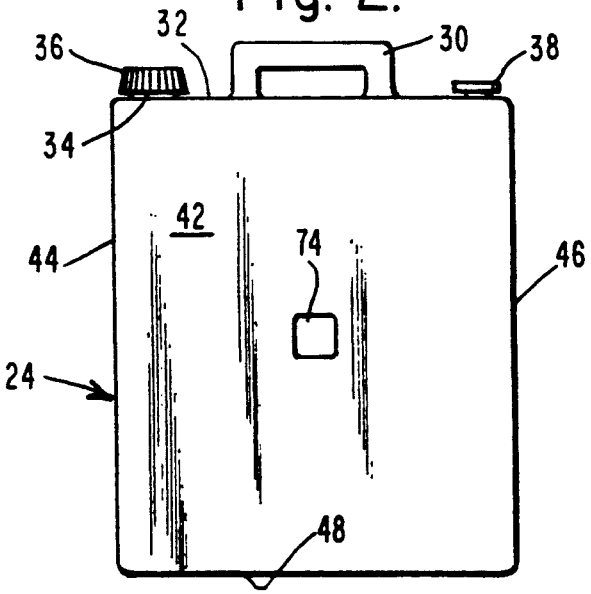
Fig. 3.
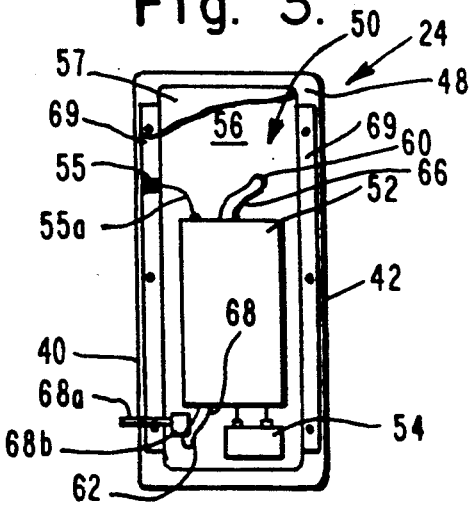

PORTABLE SHOWER AND WASH

BACKGROUND OF THE INVENTION

Field of the Invention

The present invention relates to a portable washing device and, more particularly, to such a device with a self-contained water supply, water dispensers and pumping implementation, and compartmentalized storage therefor suitable, for example, for showering and emergency washing of eyes.

Description of Related Art and Other Considerations

Portable showers and baths are well known in the art, as exemplified by the constructions disclosed in U.S. Pat. Nos. 542,688, 1,957,365, 2,454,518, 3,080,568, 4,104,744, 4,332,040 and 4,539,720. However, portability is a relative term and, from a perusal of such constructions, it is obvious that some of these are not easily transportable or exploitable and, in fact, require the use of a van to transport the shower equipment or a water tank or the need to erect and collapse one or more of the several components. In addition, many constructions are expensive and complex.

SUMMARY OF THE INVENTION

These and other problems are successfully addressed and overcome by the portable shower/emergency eye wash device embodied in the present invention. The portable device comprises a water tight enclosure in which water is stored in its interior. A source of electric power and an electrically operated pump are retained in compartment portions in the enclosure. The pump has a fluid coupling to the enclosure interior and to the water stored therein and can be electrically coupled to the power source and to sources of electric energy external to the water tight enclosure. A hose, which is connected to the pump, is adapted to be coiled and retained along with a spray head within a portion of the compartment when not in use and to be uncoiled and extended therefrom when used. A valve may be placed between the hose and the pump. If desired, a heater for the water may also be added. The enclosure is configurable so that it can be operated whether upright or lying flat.

Several advantages are derived from this arrangement. The portable shower/emergency eye wash device is more compact and better suited for transport and use than existing mechanisms. Hand transport is easily accommodated. It can be powered by any source of electrical energy, whether by its own battery, or an external power source, such as from an automobile or mobile vehicle battery or from a conventional power line. The valve may be used to afford greater control over the supply of water, for example, to preclude accidental pumping of water.

Other aims and advantages, as well as a more complete understanding of the present invention, will appear from the following explanation of exemplary embodiments and the accompanying drawings thereof.

BRIEF DESCRIPTION OF THE DRAWINGS

FIG. 1 is a plan view of a first embodiment of the present invention depicting the portable shower and spray device in use by a user;

FIG. 2 is view of the device, showing one of its large sides;

FIG. 3 is a bottom view of the device;

DETAILED DESCRIPTION OF THE PREFERRED EMBODIMENTS

Figure 4:
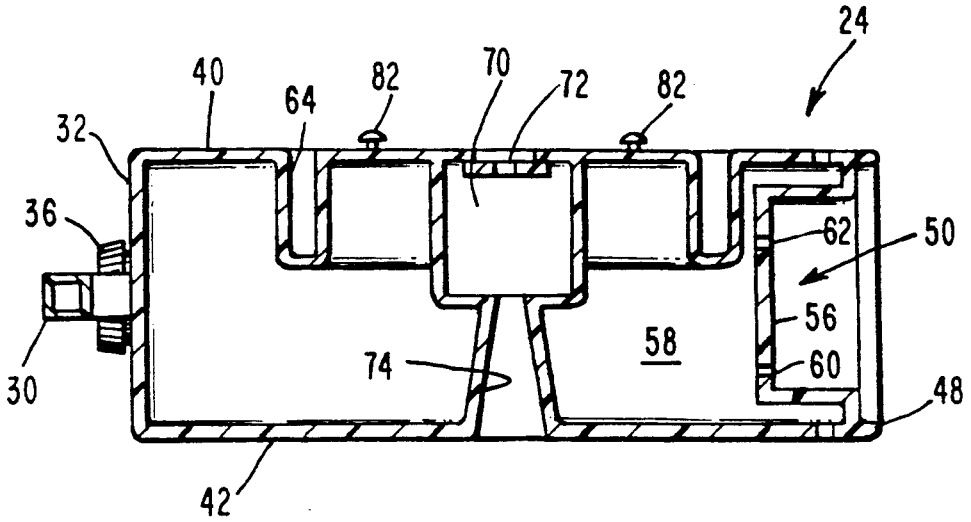
FIG. 4 is a cross-sectional view of the device, showing its interior.
Figure 5:
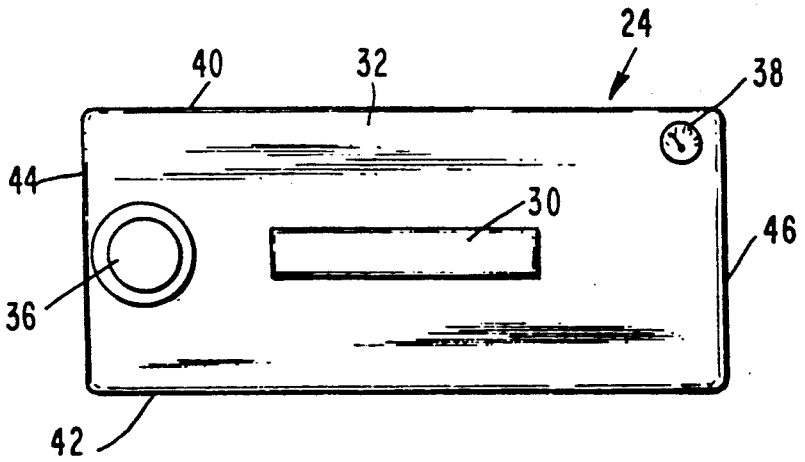
FIG. 5 is a top view of the device.
Figure 6:
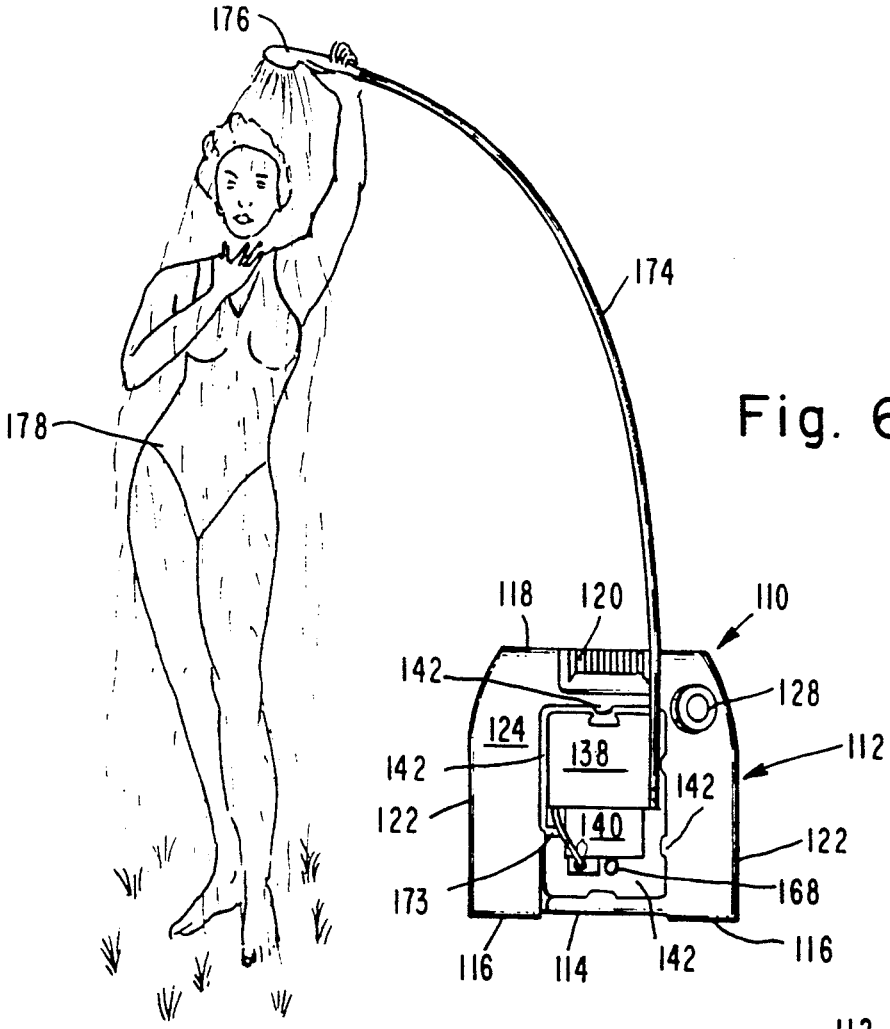
FIG. 6 is a plan view of a second embodiment of the present invention in use.
Figure 12:
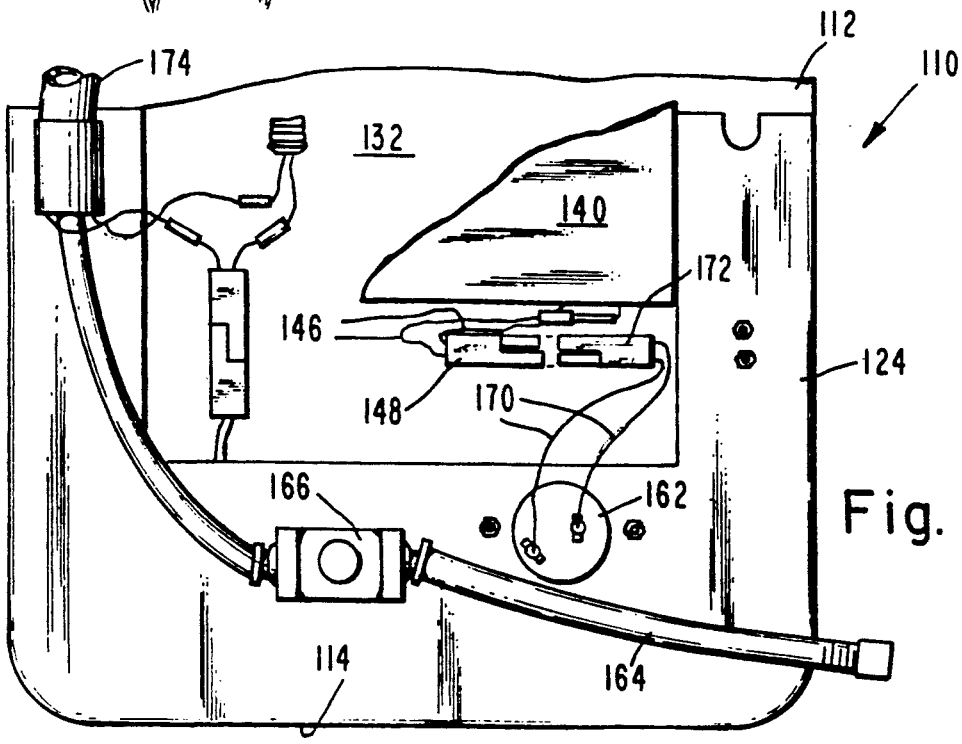
FIG. 12 is a detail view of portions of the electrical and mechanical elements of the second embodiment.
Figure 7:
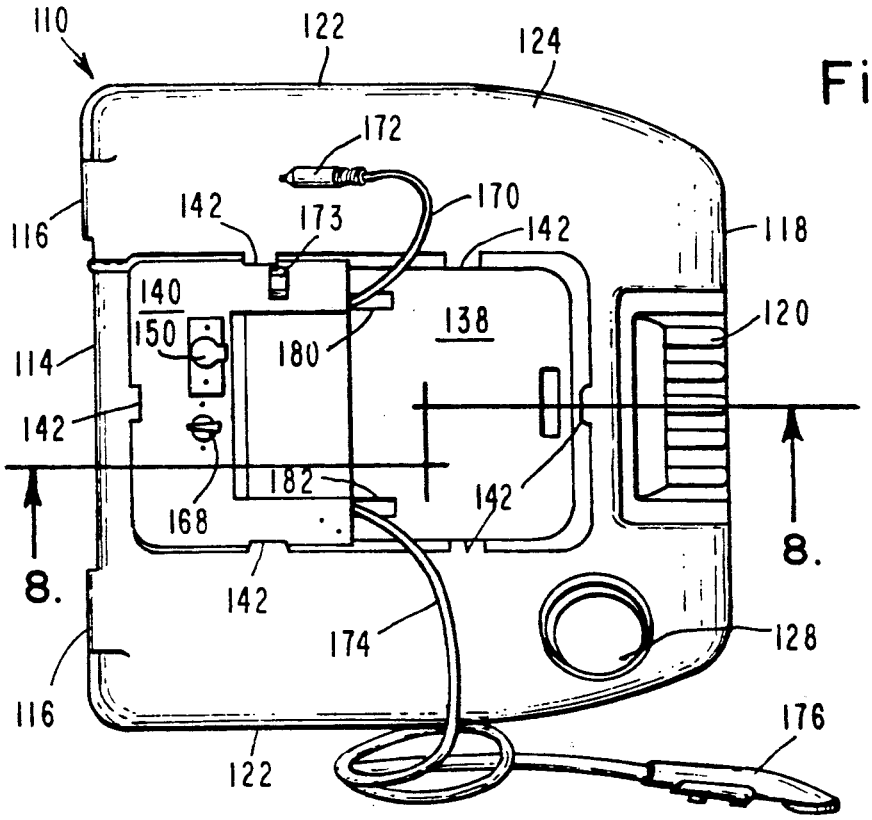
FIG. 7 is top view of the device of FIG. 6, showing its stowage compartment open.
Figure 9:
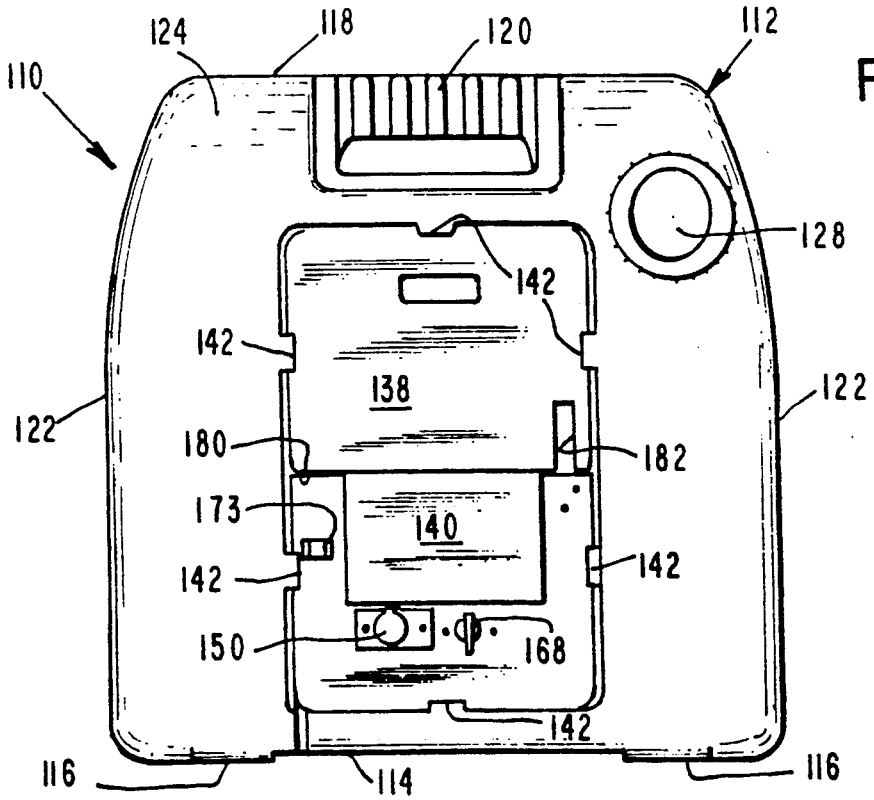
FIG. 9 depicts a top view of the second embodiment, showing its stowage compartment closed.

FIG. 1 illustrates a portable shower 20 being operated by a user 22. Shower 20 may also be used as an emergency eye wash, or any other apparatus where portability of a dispensable liquid is needed. Portable shower 20 includes a water tight enclosure 24 which holds a supply of water for shower use. The water is pumped through a hose 26 to a spray head 28 which, as shown, is directed by user 22 to be sprayed over the user's body. Spray head 28 is of conventional construction, except that it includes an on/off valve for temporarily preventing discharge of water from the spray head and for adjusting the flow of water to the spray head, and a switch for turning on the water pump. Where an electric switch is employed, hose 26 includes current carrying wires into enclosure 24.

As shown further in FIGS. 2–5, water tight enclosure 24 is provided with a carrying handle 30 secured to a top wall or handle portion 32 for enabling the user to transport the portable shower from, for example, a vehicle to a location separate from the vehicle where the shower is to be taken. Enclosure 24 may be filled in any suitable manner, such as by an inlet 34, which is sealable by a threaded cap 36. Spaced from inlet 34 is a temperature gage 38 which is secured to top wall 32 and extends into the water within the interior of enclosure 24 to inform the user of the temperature of the water.

A pair of oppositely positioned large area sides or larger side wall portions 40 and 42 and a pair of oppositely positioned smaller area sides or smaller side wall portions 44 and 46 are positioned between top wall 32 and a bottom walled or base portion 48.

As shown in FIGS. 3 and 4, bottom 48 is provided with a recessed compartment 50 into which a water pump 52 and a battery 54 are positioned and secured in any suitable manner. A socket 55 is electrically coupled to pump 52 by a cable 55*a* for enabling the pump to be electrically connected to a source of house power or an automobile battery through a plug to its cigarette lighter socket. Recessed compartment 50 includes a wall 56 which provides one end of a compartment 58 (see FIG. 4) in which the water is stored. A pair of holes 60 and 62 extend through bottom wall 56 and respectively communicate with water compartment 58 and an annularly shaped recess 64 respectively, the latter by any conventional connecting structure (not shown). Hole 60 forms a water connection between water compartment 58 and pump 52 through a connecting flexible tube and/or elbow 66 shown in FIG. 3. Hole 62 is coupled to the outlet of pump 52 by a flexible tube 68. A conduit 68*a* is secured to tube 68 by a valve 68*b* for enabling compartment 58 to be drained of water to the exterior of enclosure 24. As depicted in FIG. 3, compartment 56 is provided with ledges 69 so that a closure plate may be affixed to the ledges to close off compartment 56.

As shown in FIGS. 1 and 4, generally annularly shaped recess 64 is formed in large area side wall 40. one end of hose 26 is connected through annular recess 64 and through hole 62 to hose 68. When not in use, hose 26 may be wrapped around and stored in annular recess 64. When used, hose 26 is mostly removed from recess 64, leaving its end opposite from spray head 28 within recess 64 for connection through hole 62 with pump 52.

As illustrated in FIG. 4, a recess 70, which is centered generally within annular recess 64, is used as a storage compartment, such as for a battery charger and an extension cord which may be connected by cable 55*a* and socket 55 to a suitable source of electrical energy, such as an automobile battery or house current. A cover 72 is placeable over recess 70 to prevent any devices held therewithin from falling out. Recess 70 is further connected through a walled interconnection 74 which opens from large area side wall 42. Walled interconnection 74 may be utilized for any egress to storage compartment 70 and, more importantly, provides additional support between large area walls 40 and 42.

Annular recess or channel 64 may be closed off by a cover plate 76 (see FIG. 1), which contains two pairs of holes 78 and 80. Holes 78 and 80 are adapted to engage studs 82, shown in FIG. 4, which are screwed in or otherwise affixed to large area side wall 40. If hole pair 80 of plate 76 are engaged with studs 82, cover plate 76 covers the entirety of annular channel 64 and is used to house hose 26 when stored therein. However, during use of portable shower 20 when hose 26 is removed from recess or channel 64, plate 76 may be placed partially over recess 64 and secured to side wall 40 through engagement of holes 78 with studs 82. This enables one portion 84 of channel 64 to be exposed and to permit hose 26 to extend out of the annular recess.

Now referring to FIGS. 6–12, a portable shower 110 comprises a large water tight enclosure 112, for example, shaped like a Jerry gasoline can, having, for example, a 5 gallon capacity, and formed from any convenient material, such as of plastic or metal. Its water tight construction is formed in a conventional manner.

Water tight enclosure 112 includes a base portion 114 having protuberances or protruding supports 116 for supporting the enclosure on the ground or other supporting surface. A handle-carrying portion 118, opposed to base portion 114, is provided with a handle 120 therein.

A pair of generally parallel side wall portions 122 extend generally normally from base portion 114 and handle-carrying portion 118. A pair of generally parallel upper and lower wall portions 124 and 126 extend also generally normally from the base and handle-carrying portions, and have an area which is greater than that of side wall portions 122.

A sealable inlet 128 (see FIGS. 6, 7 and 9) is disposed in upper wall portion 124 for enabling placement of the water into enclosure 112.

Figure 8:
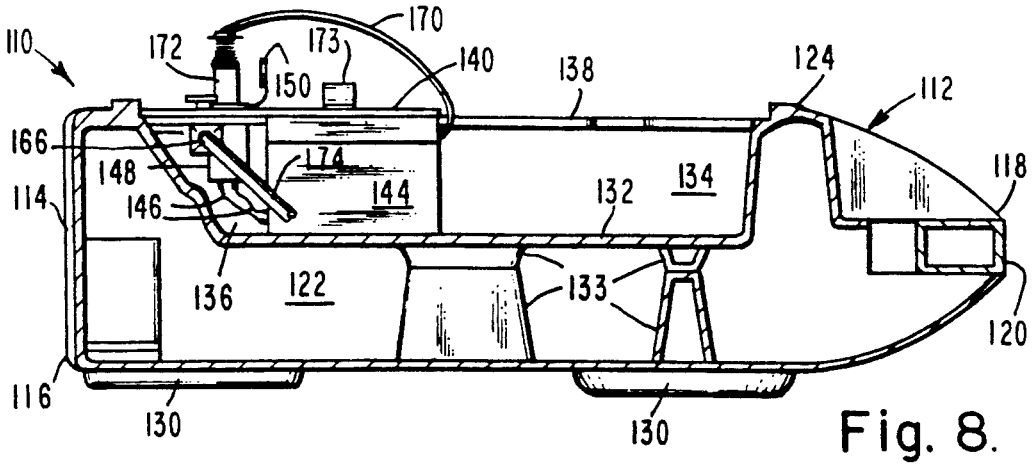
FIG. 8 is a cross-sectional view of the FIG. 6 device taken along line 8—8 of FIG. 7.
Figure 10:
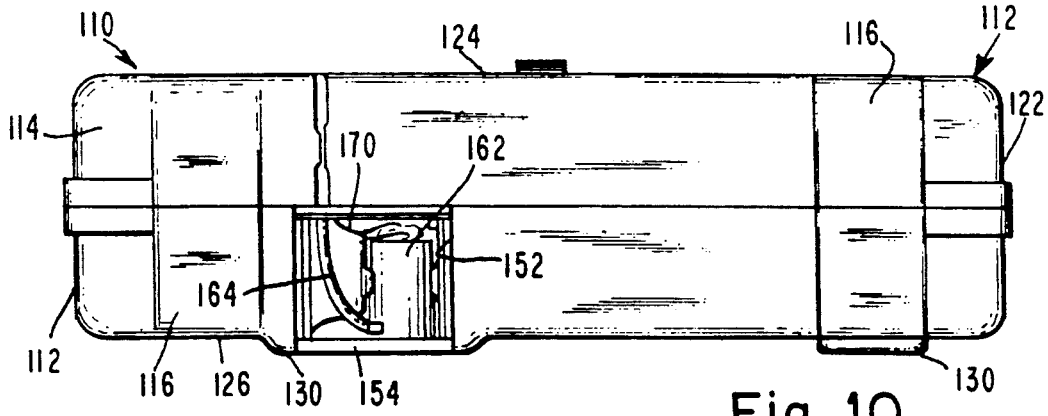
FIG. 10 is an end view of the second embodiment with its pump compartment open.
Figure 11:
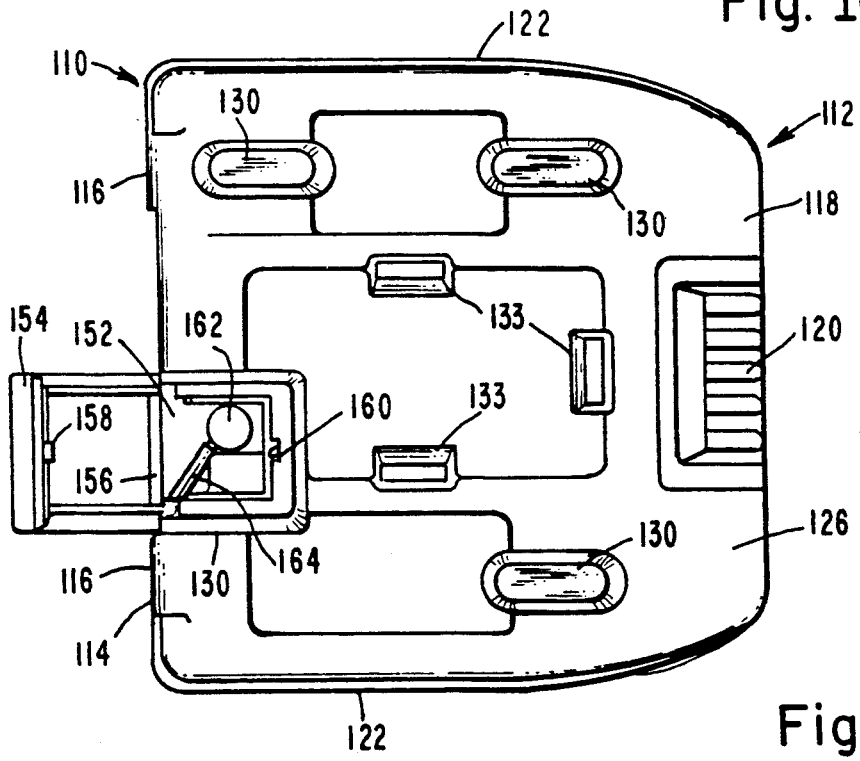
FIG. 11 is a bottom view of the second embodiment with its pump compartment open.

As shown in FIGS. 8, 10 and 11, protuberances or protruding supports 130 extend from lower wall portion 126 and are adaptable to operate as an alternate to protuberances or supports 116 on base portion 114, and function also as a support for enabling the enclosure to rest on the ground or relevant supporting surface.

A depression 132, as best seen in FIG. 8, is formed in upper wall portion 124. A plurality of struts 133 (also seen in FIG. 11) extend from the bottom of the depression and from lower wall portion 126 into a bondable connection, to provide rigidity for enclosure 112.

Depression 132 forms a pair of upper wall compartments or portions 134 and 136 in enclosure 112. Covers 138 and 140 are provided for respective upper wall portions 134 and 136, and are configured to lie substantially flat with respect to upper wall portion 124. Latching lips 142, which extend from upper wall portion 124 over upper wall portions 134 and 136, are disposed to overlie covers 138 and 140 when the covers are slipped under the lips, and thereby provide an interengageable means for enabling a releasable securement of the covers with the upper wall compartments.

As illustrated also in FIG. 8, a battery 144 is positioned within upper wall compartment portion 136 and abuts against cover 140 for enabling it to be securely retained within that upper wall compartment. Wires 146 couple battery 144 is to a terminal electric connector 148, preferably of a socket type, which is protected when an electric plug is not connected to it, by a covering spring-loaded cap 150 of conventional construction.

A pump compartment 152 (see FIGS. 10 and 11, in particular) is formed in base portion 114 and lower wall portion 126. An generally corner-shaped cover 154 is pivotally secured to base portion 114 by a hinge 156 and is latchable with lower wall portion 126 by a latch 158 and keeper 160. Thus, cover 154 is securable to close the pump compartment.

An electrically operated pump 162 is secured and retained within pump compartment 152, and has a fluid coupling to the interior of enclosure 112 and to the water therein and another fluid coupling 164 to a valve 166. Valve 166 is opened and closed by a handle 168.

Wires 170 couple pump 162 to an electrical connector, preferably a plug 172, which is adapted to be coupled to socket 148 or to a motor vehicle socket, such as is provided by a cigarette lighter, or to a source of alternating current through an appropriate alternating to direct current converter. Therefore, pump 162 may be operated by a variety of power sources, depending upon where portable shower 110 is to be used and what power sources are available as an alternate to battery 144.

A bracket 173 is provided on cover 140 to receive plug 172 when not otherwise coupled to a source of electrical energy and when the plug and its wires 170 are not stored in compartment 134.

Valve 166 secures pump 162 to a hose 174, which terminates in a spray head 176. The spray head is manipulable by a user 178.

Hose 174 is adapted to be coiled and retained with spray head 176 within upper wall compartment 134 when not in use and to be uncoiled and extended when used. In addition, as stated above, plug 172 and its wires 170 may also be stored in compartment 134.

Slots 180 and 182 are formed in cover 138, respectively for passage of wires 170 and hose 174, to permit cover 134 to be latched onto upper wall portion 124 during use of portable shower 110.

Although the invention has been described with respect to particular embodiments thereof, it should be realized that various changes and modifications may be made therein without departing from the spirit and scope of the invention.

I claim:

1. A portable shower device comprising:

a base portion having a compartment therein; a handle-carrying portion opposed to said base portion and provided with a handle;

a first pair of generally parallel side wall portions extending generally normally from said base portion and said handle-carrying portion;

a second pair of generally parallel wall portions extending generally normally from said base and handle-carrying portions, said second pair of wall portions having an area which is greater than that of said first pair of side wall portions;

said portions defining a water tight enclosure;

a sealable inlet disposed in one of said portions for enabling placement of the water into said enclosure;

an annularly shaped recess in one of said second pair of wall portions;

an electrically operated pump secured within said base portion compartment, said pump having a fluid coupling to the enclosure interior and to the water a fluid coupling to the enclosure interior and to the water therein and an electric coupling matable to sources of electric power;

a hose having a spray head connected at one end and being connected to said pump at the other end through said annularly shaped recess;

said spray head and said hose being adapted to be coiled and retained within said annularly shaped recess means when not in use and to be uncoiled and extended therefrom when used;

a cover plate having two pairs of holes therein;

a pair of studs extending from said one of said second pair of wall portions;

wherein with said spray head and said hose housed in said recess said plate having one of said pair of holes engaged with said studs will cover said annular recess and with said spray head and hose retracted from said annular recess the other of said pair of holes can be engaged with said studs so that said plate will cover only a portion of said annular recess.

* * * * *